US006820693B2

(12) United States Patent
Hales et al.

(10) Patent No.: US 6,820,693 B2
(45) Date of Patent: Nov. 23, 2004

(54) ELECTROMAGNETIC TELEMETRY ACTUATED FIRING SYSTEM FOR WELL PERFORATING GUN

(75) Inventors: John H. Hales, Frisco, TX (US); Brian R. Duea, Carrollton, TX (US); Rebecca A. McConnell, Lewisville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/995,882

(22) Filed: Nov. 28, 2001

(65) Prior Publication Data

US 2003/0098157 A1 May 29, 2003

(51) Int. Cl.[7] ..... E21B 43/00
(52) U.S. Cl. ..... 166/297; 166/55.1; 166/66.4
(58) Field of Search ..... 166/297, 298, 166/55, 55.1, 66.4, 66.5

(56) References Cited

U.S. PATENT DOCUMENTS

| | | | | |
|---|---|---|---|---|
| 1,757,288 A | | 5/1930 | Bleecker | |
| 3,227,228 A | | 1/1966 | Bannister | |
| 3,233,674 A | | 2/1966 | Leutwyler | |
| 3,421,440 A | * | 1/1969 | Snyder | |
| 3,737,845 A | | 6/1973 | Maroney et al. | |
| 4,302,757 A | | 11/1981 | Still | 340/854 |
| 4,617,960 A | | 10/1986 | More | |
| 4,656,944 A | * | 4/1987 | Gonzalez | 102/312 |
| 4,739,325 A | | 4/1988 | MacLeod | 340/854 |
| 4,953,616 A | | 9/1990 | Borden et al. | 166/66.4 |
| 5,531,270 A | | 7/1996 | Fletcher et al. | 166/53 |
| 6,199,628 B1 | * | 3/2001 | Beck et al. | 166/53 |
| 2003/0000702 A1 | * | 1/2003 | Streich et al. | 166/278 |

FOREIGN PATENT DOCUMENTS

| | | |
|---|---|---|
| EP | 0200535 A2 | 11/1986 |
| EP | 0922836 A1 | 6/1999 |

* cited by examiner

*Primary Examiner*—William Neuder
(74) *Attorney, Agent, or Firm*—J. Richard Konneker

(57) ABSTRACT

A perforating gun assembly for use in a subterranean well incorporates therein an electromagnetic frequency receiver coupled to a motor section which, in turn, is coupled to the mechanically actuatable firing head portion of the perforating gun. The assembly is lowered into a cased wellbore to a subterranean formation location, and a surface-disposed transmitter generates encoded electromagnetic waves through the earth to the receiver. Upon sensing in the received waves a predetermined frequency and embedded firing code, the receiver electrically operates the motor which, in turn, mechanically actuates the firing head to initiate the firing of the perforating gun. While the assembly is illustratively lowered into the wellbore on a tubing structure, a variety of non-tubing structures may be alternatively utilized to lower the gun assembly into the wellbore and operatively support it therein.

59 Claims, 4 Drawing Sheets

FIG. 1
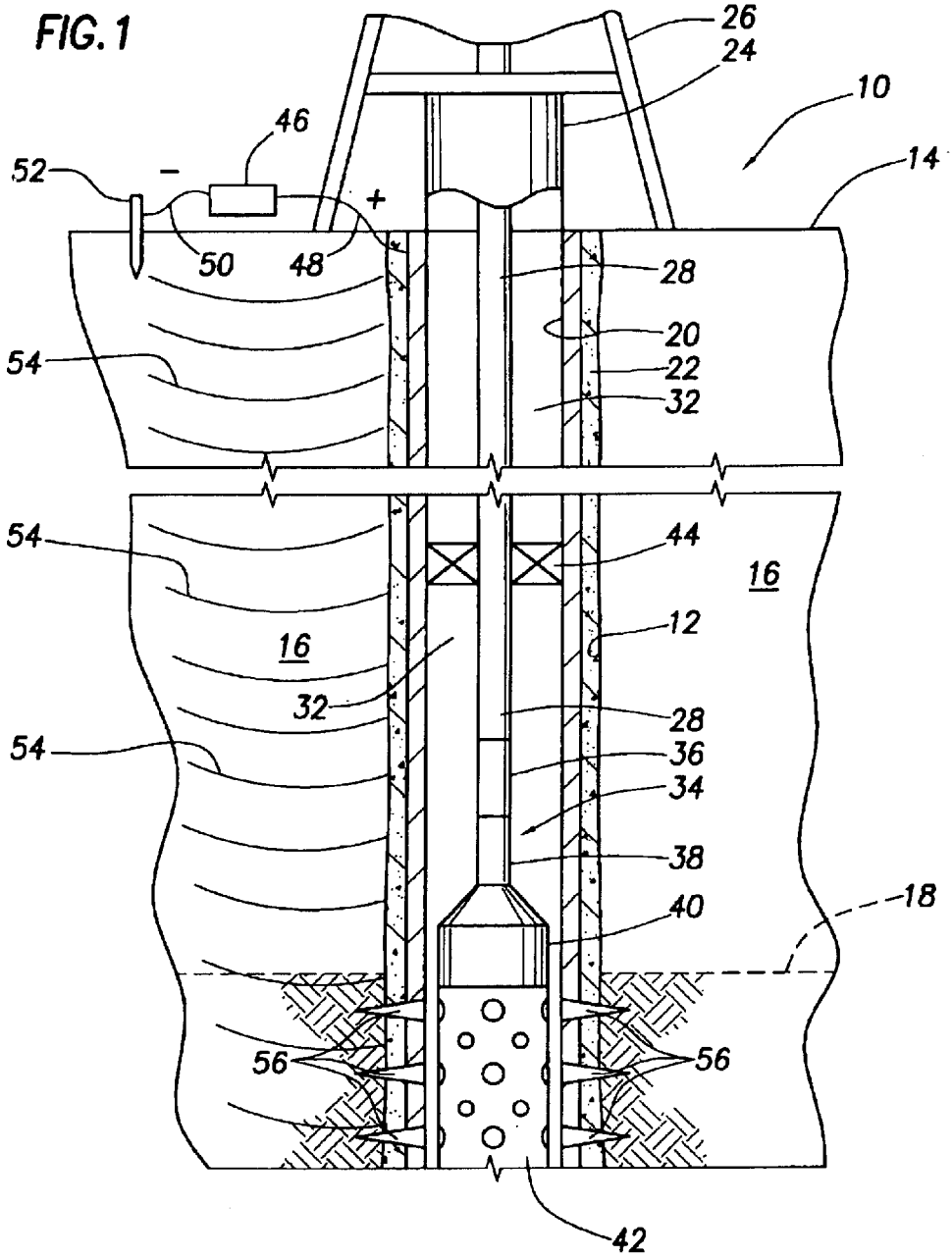
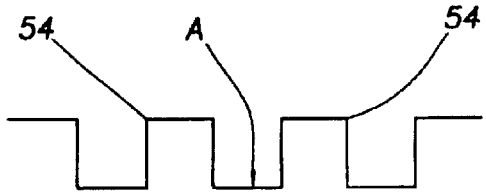
FIG. 2

ELECTROMAGNETIC TELEMETRY ACTUATED FIRING SYSTEM FOR WELL PERFORATING GUN

BACKGROUND OF THE INVENTION

The present invention generally relates to control of downhole well tools and, in a preferred embodiment thereof, more particularly relates to an electromagnetic telemetry actuated firing system for a well perforating gun.

In a typical construction of a subterranean well, a metal-cased wellbore is extended downwardly through the earth and through a fluid-bearing formation beneath the earth's surface. To operatively communicate the formation with the interior of the casing for subsequent delivery of formation fluid to the surface, perforations are formed through the casing and outwardly into the formation using a perforating gun structure which is lowered through the casing, typically on a tubing string, to the level of the subterranean formation.

A firing head portion of the lowered perforating gun structure is subsequently actuated to fire the gun and create the desired casing perforations. Perforating gun firing heads are customarily of either a mechanically actuatable or electrically actuatable construction. A mechanical firing head is typically actuated by pressure, or a mechanical device dropped down the tubing to depress a plunger portion of the firing head and thereby initiate firing of the gun. An electrical firing head is typically actuated by an electrical current supplied to a blasting cap attached to the head to detonate the gun charges. Evolving wellbore technologies and completion techniques have surpassed the ability of current tubing conveyed perforating firing systems to fire their guns by the use of pressure or mechanical means. Moreover, due of such evolving wellbore technologies, a variety of wells simply cannot be perforated using conventional techniques.

For the foregoing reasons it can readily be seen that a need exists for improved apparatus and methods for firing perforating guns that eliminate or at least substantially reduce the above-noted problems, limitations and disadvantages typically associated with conventional perforating gun firing apparatus and methods.

SUMMARY OF THE INVENTION

In carrying out principles of the present invention, in accordance with a preferred embodiment thereof, a specially designed well tool assembly is provided for operative placement in a subterranean wellbore, the well tool assembly representatively being a remotely actuatable mechanical perforating gun assembly operable to form perforations in a metal casing portion of the wellbore.

The perforating gun assembly, when disposed downhole, is selectively operable by an electromagnetic telemetry actuated firing system that includes a surface-disposed transmitter operable to propagate electromagnetic waves through a portion of the earth exteriorly adjacent the wellbore casing. Preferably, the electromagnetic waves are modulated square sine or cosine waves having a frequency in the range of from about 15 HZ or less, and have a predetermined firing address encoded therein.

The perforating assembly illustratively includes a perforating gun having a mechanically actuatable firing head, an actuating section connected to the firing head and having a motor portion operable to mechanically actuate the firing head, and a receiver operable to detect the electromagnetic waves and responsively operate the motor. The perforating gun assembly may also have a sensor portion for sensing a selected downhole parameter, and a transmitter for propagating through the earth electromagnetic waves indicative of the value of the sensed downhole parameter. These waves may be detected by a suitable surface-disposed receiver.

While the well tool assembly is representatively a perforating gun assembly, other types of well tool assemblies may be utilized if desired and actuated using the electromagnetic telemetry actuating system of the present invention.

According to one aspect of the invention, the tool assembly receiver has a control circuitry portion, and the tool assembly has first and second electrically conductive paths which are insulatively isolated from one another and are respectively operative to transmit an electromagnetic wave signal from a first casing portion to the receiver control circuitry portion with respect to a ground reference from a second casing portion, spaced apart a substantial distance in a downhole portion from the first casing portion, to the control circuitry portion. The receiver control circuitry portion representatively has programmed therein a wave frequency value and a firing address which must be matched with the frequency and firing address of the detected electromagnetic before the circuitry is operative to fire the perforating gun.

Illustratively, the well tool assembly has an elongated, electrically conductive tubular outer body portion and a generally coaxially extending electrically conductive tubular inner body portion, each of the outer and inner body portions having insulative gaps formed therein between adjacent longitudinal sections thereof. Preferably, the adjacent longitudinal sections of the tubular outer body portion has axially spaced apart threaded end portions threadedly connected to an annular collar member at thread joints containing an electrically insulative material defining spaced apart insulation gaps between the longitudinal sections of the outer body portions and electrically isolating them from one another.

According to another feature of the invention, the receiver has a circuit board portion with a main CPU portion adapted to receive an electromagnetic wave detection signal and a ground reference and responsively generate an actuation request signal, and an auxiliary fail-safe CPU portion operative to receive the actuation request signal, monitor selected parameters of the well tool assembly to detect whether system errors exist, and responsively generate a final actuation signal, to actuate the tool portion of the assembly, only in the absence of sensed system errors.

The perforating gun assembly may be operatively supported in the wellbore on a variety of support structures including a tubing string, coil tubing, wire line, slick line or a casing hanger. The electromagnetic telemetry actuated firing system of the present invention provides a variety of advantages over conventional perforating gun firing systems. For example, the system is essentially wireless, with no downhole cabling required.

The motor section of the well tool may have an output member which is translatable in a selectively variable direction through a selectively adjustable stroke. Additionally, the overall well tool assembly may comprise a plurality of separately actuatable well tools which may be actuated in any desired sequence.

BRIEF DESCRIPTION OF THE DRAWINGS

FIG. 1 is a schematic cross-sectional view through a portion of a subterranean well having disposed therein a perforating gun assembly with which is operatively associated a specially designed electromagnetic telemetry actuated firing system embodying principles of the present invention;

FIG. 2 is a schematic depiction of a preferred electromagnetic wave pattern transmitted through the earth to a receiver portion of the perforating gun assembly;

DETAILED DESCRIPTION

Figure 3A:
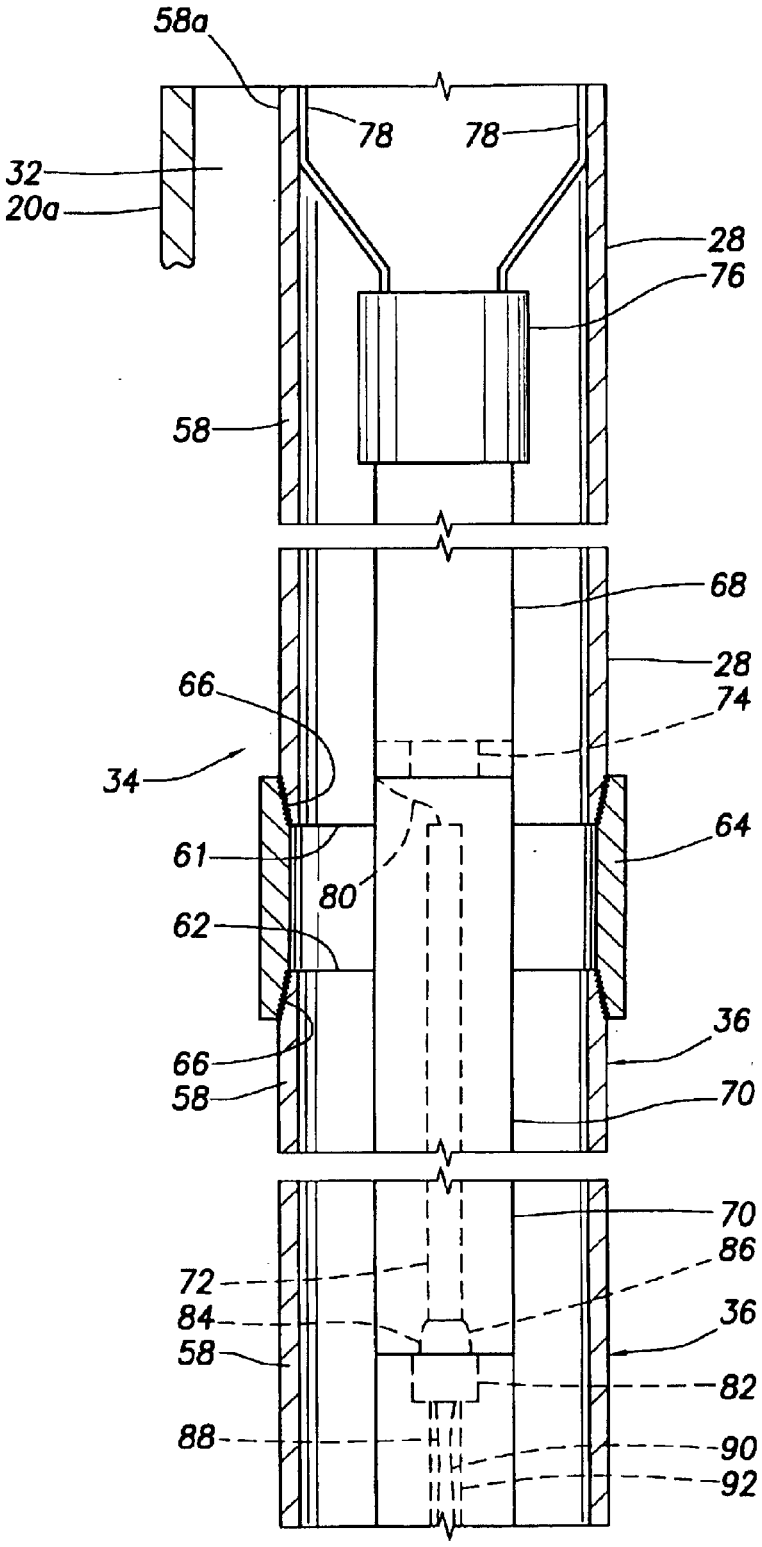
FIGS. 3A and 3B are enlarged scale schematic cross-sectional views, partly in elevation, through vertically successive portions of the overall perforating gun assembly.

Schematically depicted in cross-sectional form in FIG. 1 is a portion of a well 10 including a wellbore 12 extending downwardly from the surface 14 of the earth 16 through a subterranean hydrocarbon fluid-containing formation 18. Wellbore 12 is lined with a tubular metal casing 20 which is cemented into the wellbore 12, as at 22, and is associated at its upper end with a wellhead portion 24 of a drilling rig 26 at the surface 14. A tubing string 28 extends downwardly from the wellhead 24 centrally through the casing 20 and forms with the casing 20 an annulus 32 that circumscribes the tubing string 28.

Supported on a lower end portion of the tubing string 28 is a well tool assembly that embodies principles of the present invention and is representatively a perforating gun assembly 34. From top to bottom as viewed in FIG. 1, the perforating gun assembly 34 includes an electromagnetic frequency receiver 36, an electrically operable motor control section 38, a mechanically actuatable firing head 40, and a perforating gun 42, each of which has a generally tubular configuration. The firing head 40 and the perforation gun 42 together form an actuatable well tool.

The perforating gun assembly 34 is operatively positioned within the casing by lowering the assembly 34 through the casing 20 on the tubing string 28 until, as shown in FIG. 1, the perforating gun 42 is positioned in the subterranean formation 18. An optional packer 44 is then set in the annulus 32 above the positioned assembly 34 to seal off a portion of the annulus 32 below the packer 44 from the portion of the annulus 32 above the packer 44.

Still referring to FIG. 1, well 10 also includes a surface-disposed electromagnetic wave transmitter 46 having a positive electrical lead 48 connected to an upper end portion of the metal casing 20, and a negative or grounding electrical lead 50 coupled to the earth 16, representatively via a metal grounding stake 52. When it is desired to fire the perforating gun 42, the transmitter 46 is operated to transmit through the earth 16 electromagnetic waves 54 which are received by the receiver 36. In a manner subsequently described in greater detail herein, in response to detecting the waves 54 the receiver 36 transmits an electrical firing signal to the electric motor control section 38. Motor section 38, in response to the receipt of the electrical firing signal from the receiver 36, then mechanically actuates the mechanically actuatable firing head 40 which, in turn, fires the perforating gun 42 to create casing perforations 56 that extend outwardly through the casing 20 and the cement 22 and communicate the formation 18 with the interior of the casing 20.

At this point it should be noted that the present invention permits a mechanically actuatable downhole well tool assembly (representatively the gun assembly 34) to be selectively actuated using electromagnetic waves transmitted through the earth. Accordingly, the portion of the tubing string 28 above the receiver is used only to lower and support the assembly 34—this portion of the tubing 28 is not needed to receive and guide a dropped mechanical firing member to the firing head 40 to transmit a pressure signal to the firing head 40, or to receive and guide a lowered electrical line to electrically actuate the firing head 40. This feature of the invention permits the gun assembly 34 to be lowered through the casing 20, and operatively supported therein, in a variety of other manners not utilizing a tubing string extending to the surface 14. Examples of alternate lowering and support structures include, for example, wire line, slick line, coil tubing, drill pipe, or a casing hanger structure for supporting the lowered assembly.

AS previously mentioned, principles of the present invention are not limited to the illustrated perforating gun assembly 34—such principles could also be advantageously employed with a variety of other types of actuatable downhole well tools. Also, while the illustrated perforating gun 42 is mechanically actuatable via its firing head 40 as later described herein, principles of the present invention could also be advantageously utilized in conjunction with electrically actuatable downhole well tools.

With reference now to FIGS. 1 and 2, the electromagnetic waves 54 propagated through the earth 16 by the transmitter 46 are preferably modulated square sine or cosine waves (see FIG. 2) of the QPSK (quadrature phase shift keying) pulse type which desirably increases the power of the waves and correspondingly increases the maximum earth depth through which they may be effectively transmitted. For purposes later described herein, a predetermined firing address A is suitably encoded in the electromagnetic waves 54 as schematically indicated in FIG. 2. Preferably, the frequency of the electromagnetic waves 54 propagated through the earth 16 by the transmitter 46 is variable within the ULF/ELF frequency range of about 15 Hz or less.

Figure 3B:
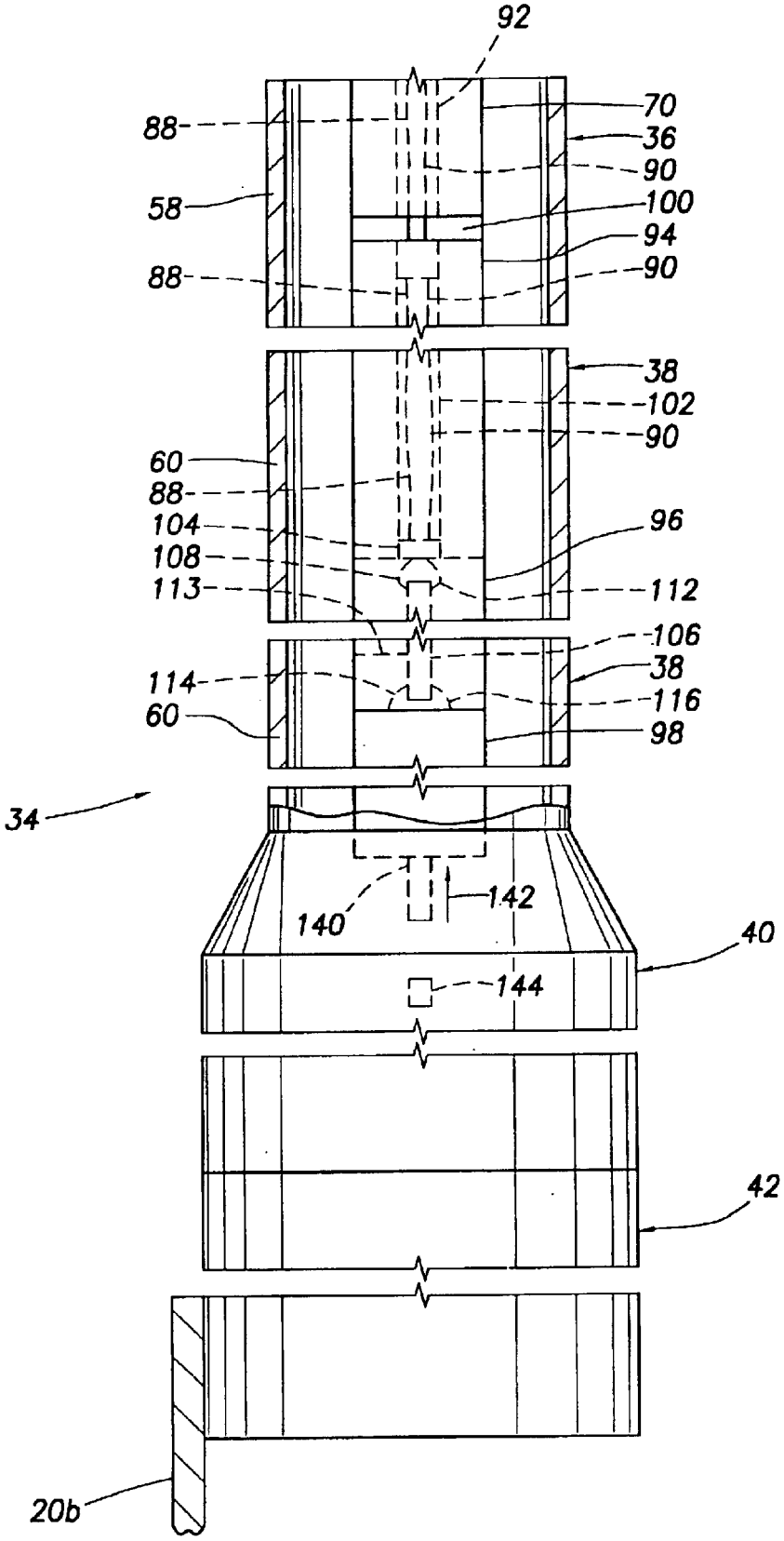

Turning now to FIGS. 3A and 3B, the mechanically actuatable firing head 40 and the perforating gun 42 are of metal, electrically conductive constructions as are tubular outer metal body portions 58,60 of the assembly 36. These body portions 58,60 are representatively defined by lower sections of the metal tubing string 28. As illustrated in FIG. 3A, a lower end 61 of an upper section of the body portion 58 is upwardly spaced apart from the upper end 62 of a lower section of the body portion 58. These spaced apart end portions 61 and 62 are externally threaded and are threaded into an internally threaded annular metal connection collar 64. For purposes later described herein, a suitable electrically insulative material 66 is disposed in the mated thread areas of the collar 64 and the spaced apart body end portions 61,62 and serves to form dual insulating gaps 66—66 between the body end portions 61,62 and thereby prevent electrical conductance therebetween.

As schematically depicted in FIG. 3A, the specially designed receiver 36 has a cylindrical, electrically conductive interior portion centrally extending through the outer housing 58 and extending upwardly into the lower end of the tubing string 28, such interior portion including an upper battery section 68 and a lower receiver control section 70 having a circuit board 72 operatively disposed within its interior. Sections 68,70 are electrically coupled by a connector structure 74 interposed therebetween. The upper end of the battery section 68 has secured thereto an electrically conductive centralizer structure 76 with flexible metal arm portions 78 that slidably engage an interior side surface of an outer body portion 58*a* horizontally facing a corresponding section 20*a* of the casing.

An upper end portion of the circuit board 72 is electrically coupled to an outer wall portion of the receiver control section 70 by an electrical lead 80, and a lower end portion of the circuit board 72 is coupled to an electrical connector 82 by electrical leads 84 and 86, lead 84 being a ground lead and lead 86 being a firing signal lead. Electrical leads 88,90 extend downwardly from the connector 82 through a central passage portion 92 of the receiver control section 70, with leads 88,90 being respectively coupled to the leads 84,86 through the connector 82.

Turning now to FIG. 3B, the motor control section 38 has a cylindrical, electrically conductive interior portion centrally extending through the outer housing 60 and extending upwardly into the lower end of the outer housing 58, such interior portion including, from top to bottom as viewed in FIG. 3B, a battery section 94, a motor control section 96 and an electric motor 98. For purposes later described herein, a suitable electrically insulative material 100 is suitably interposed between adjacent end portions of the receiver control section 70 and the battery section 94 to form an insulating gap therebetween and preclude electrical conduction between these sections.

Electrical leads 88 and 90 are appropriately routed through the battery section 94, through a central passage 102 therein, and coupled to a connector 104 disposed at a bottom end portion of the battery section 94. The motor control section 96 has a circuit board 106 disposed therein. The upper end of the circuit board 106 has a ground lead 108 which, via the connector 104, is coupled to the lead 88. The upper end of the circuit board 106 also has an electrical lead 112 which is coupled to the electrical lead 90 via the connector 104. At the bottom end of the circuit board 106 are motor control leads 114 and 116 operatively coupling the circuit board 106 to the electric motor 98. A lower end portion of circuit board 106 is grounded to the housing of motor control section 96 via a suitable grounding path 113.

As schematically depicted in FIG. 3B, the perforating gun 42 contacts a portion 20*b* of the casing which is in a downwardly spaced apart relationship with the casing portion 20*a* (see FIG. 3A) adjacent the outer body portion 58*a* conductively contacted by the centralizer arms 78. Accordingly, during propagation through the earth 16 of the electromagnetic waves 54 by the transmitter 46 (see FIG. 1) the electrical potential at the upper casing section 20*a* is appreciably higher than at the lower casing section 20*b*. The previously described dual insulating gaps 66—66 in the outer body portion 58 (see FIG. 3A) and the insulating gap 100 between the receiver control section 70 and the motor control section 96 advantageously permit the simultaneous communication to the receiver circuit board 72 of received, relatively high potential electromagnetic wave signals from the upper casing portion 20*a* with respect to a relatively low potential ground reference from the lower casing portion 20*b* through first and second conductive paths which are electrically isolated from one another.

When it is desired to fire the in-place perforating gun 42, the transmitter 46 is activated to propagate the electromagnetic waves 54 through the earth 16, with the waves 54 being propagated at a predetermined frequency, and with the preselected firing address A encoded therein, the frequency and encoded firing address matching a corresponding firing frequency and address pre-programmed into the electronic circuitry of the receiver circuit board 72. Propagated electromagnetic wave signals received at the upper casing section 20*a* (see FIG. 3A) are transmitted across the casing annulus 32 to the outer body portion 58*a* and from the outer body portion 58*a* to the receiver circuit board 72, sequentially via the centralizer 76, outer wall portions of the battery and control sections 68 and 70, and the lead 80, in the form of a wave input signal 118 (see FIG. 4). If desired, a second electrically conductive resilient centralizer (not shown) may be placed between and in conductive contact with the casing section 20*a* and the outer body portion 58*a* to facilitate the transmission of electromagnetic wave signals therebetween.

While the electromagnetic waves 54 are being propagated through the earth 16, the lower casing section 20*b* (see FIG. 3B) is at an appreciably lower electrical potential than the electrical potential of the upper casing section 20*a* (see FIG. 3A) from which the lower casing section 20*b* is conductively isolated by the dual insulation gaps 66—66 (see FIG. 3A). This lower (or "ground") potential of the lower casing section 20*b* is connected to the receiver circuit board 72 (see FIG. 4) as a ground reference 120 (through a conductive path isolated from the conductive path through which the wave input signal 118 reaches the circuit board 72) sequentially via the perforating gun 42 (see FIG. 3B), the firing head 40, body portions of the motor 98, the outer housing of the motor control section 96, the grounding path 113, the motor control circuit board 106, the lead 108, the connector 104, the lead 88, the connector 82 (see FIG. 3A), and the lead 84.

Figure 4:
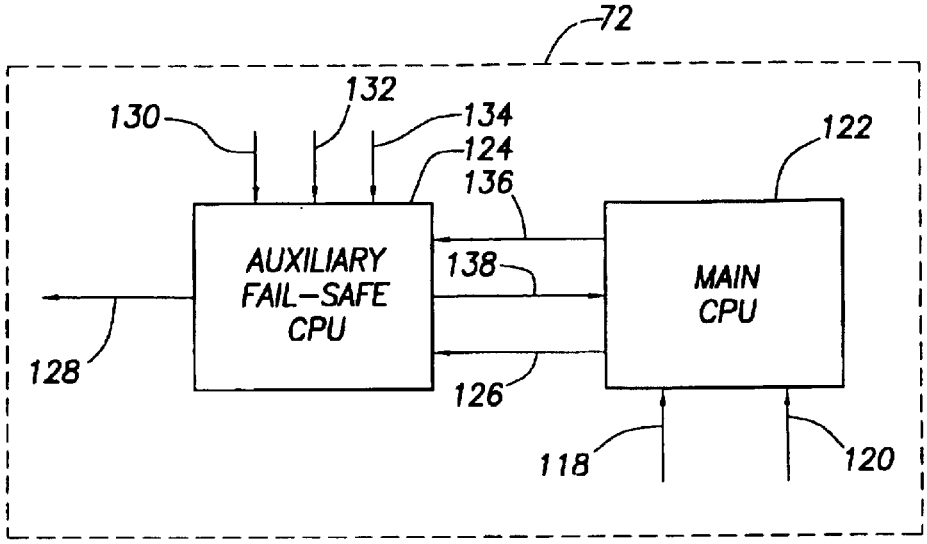
FIG. 4 is a schematic block diagram of a portion of a dual processor circuit board used in an electromagnetic frequency receiver portion of the perforating gun assembly.

As schematically shown in FIG. 4, the receiver circuit board 72, according to a feature of the present invention, is preferably provided with a main CPU portion 122, which receives the wave input and ground signals 118 and 120, and an auxiliary fail-safe CPU portion 124. If the wave input signal 118 has a frequency and encoded firing address respectively matching the corresponding frequency and firing address programmed into the main CPU 122, the main CPU 122 transmits a firing request signal 126 to the auxiliary fail-safe CPU 124 which verifies the absence of various preselected malfunctions in the overall firing system before responsively transmitting a final electrical firing signal 128 to the motor controller section 96 (see FIG. 3B).

For example, before outputting the final firing signal 128, the auxiliary fail-safe CPU 124 verifies (via power inputs 130,132,134 thereto) that the various voltages in the overall receiver circuitry are at correct levels, and (via reset signals 136,138 transmitted between the two CPU's 122,124) that no defects are present in the various system reset functions. If a system parameter error is detected by the auxiliary fail-safe CPU 124 it will not generate the final firing signal 128, even if the main CPU 122 generates the firing request signal 126.

If the final firing signal 128 is generated by the auxiliary fail-safe CPU 124, the signal 128 is delivered to the motor 98 (see FIG. 3B) sequentially via the lead 86 (see FIG. 3A), the connector 82, the lead 90, the connector 104 (see FIG. 3B), the lead 112, the motor controller circuit board 106, and the leads 114 and 116. Receipt of the final firing signal 128 by the motor 98 causes the motor 98 to upwardly extend a movable rod portion 140 of the motor, as indicated by the arrow 142 in FIG. 3B, in a manner causing the rod 140 to disengage and release an underlying plunger portion 144 of the firing head 40, at the same time allowing wellbore pressure to drive the plunger. This mechanically actuates the firing head 40 which, in turn and in a conventional manner, fires the perforating gun 42. The motor 98 may be operative to translate the rod 140 in selectively variable directions through a selectively adjustable stroke if desired.

A variety of modifications can be made to the representatively illustrated perforating gun assembly 34 (see FIG. 1), if desired, without departing from general principles of the present invention. For example, the receiver 36, motor control 38 and firing head 40 could be positioned on the bottom end of the perforating gun 42 instead of its top end as schematically depicted in FIG. 1. Further, one or more additional perforating gun assemblies 34 could be utilized within the casing 20 instead of the single perforating gun assembly 34 illustratively shown in FIG. 1. Additionally, the specially designed perforating gun assembly 34 could also be advantageously utilized in conjunction with the transmitter in a subsea well application.

Figure 5:
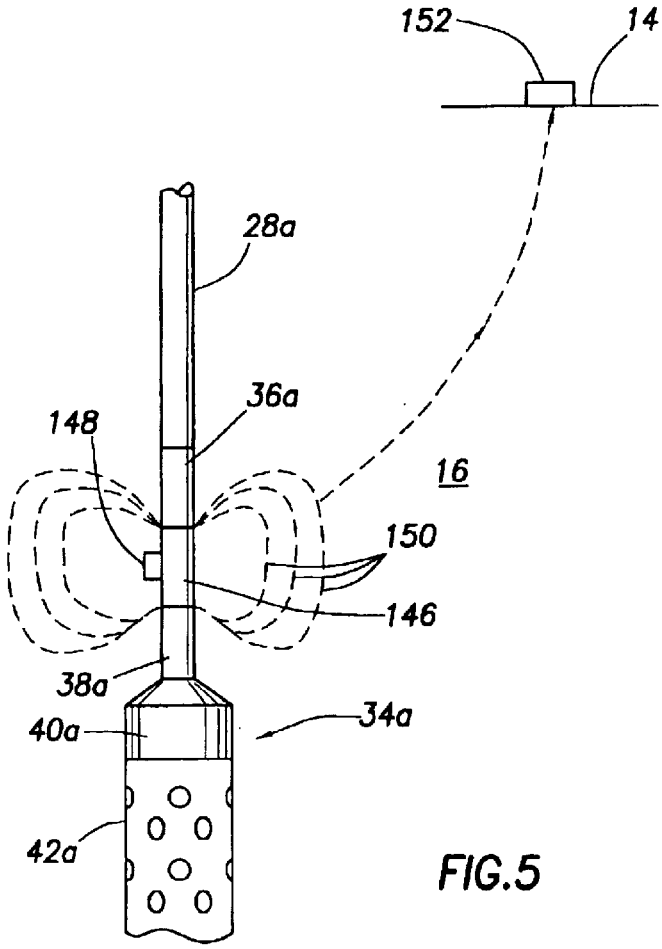
FIG. 5 is a schematic side elevational view of an alternate embodiment of the perforating gun assembly.

While the depicted perforating gun assembly 34 is representatively designed to operate on a "receive only" basis, it can be easily modified to additionally transmit selected data to the surface if desired. For example, an alternate embodiment 34*a* of the previously described perforating gun assembly 34 is schematically shown in FIG. 5. For ease in comparing the assembly embodiment 34*a* to the previously described assembly embodiment 34, elements in the assembly embodiment 34*a* similar to those in the assembly embodiment 34 have been given the same reference numerals to which the suffixes "a" have been appended.

In the alternate perforating gun assembly embodiment 34*a*, an electromagnetic frequency transmitter 146 is added to the assembly 34*a*, representatively between the receiver 36*a* and the motor section 38*a*, and is associated with a suitable sensor 148 operative to sense a predetermined downhole parameter, such as temperature or pressure. The transmitter 146 may be utilized to propagate electromagnetic waves 150 through the earth 16 to a suitable surface receiver 152, the waves 150 having suitable characteristics imparted thereto which are indicative of the sensed downhole parameter.

Figure 6:
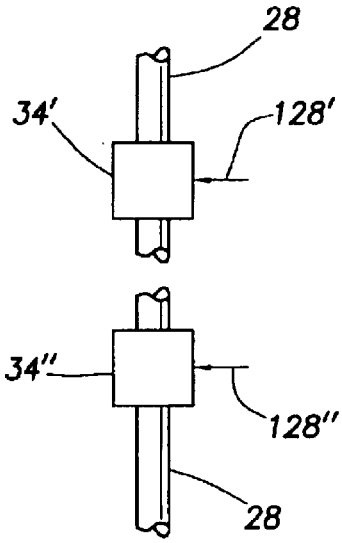
FIG. 6 is a schematic side elevational view of a multiple perforating gun assembly.

While a single well tool assembly 34 (representatively a perforating gun assembly) has been illustratively depicted as being operatively positioned within the wellbore 12 (see FIG. 1), a plurality of well tool assemblies, such as the well tool assemblies 34' and 34" schematically depicted in FIG. 6, may alternatively be supported in the wellbore 12 on, for example, the tubing 28. These well tool assemblies 34' and 34" may be sequentially actuated, in any predetermined order, in response to their receipt of actuating signals 128', 128" generated by their receiver sections in response to their detections of corresponding electromagnetic waves being propagated through the earth by the transmitter 46. The electromagnetic waves that create these actuating signals 128',128" have different actuating addresses encoded therein, and may also have different frequencies.

The electromagnetic telemetry actuated firing system representatively described above provides a variety of advantages over conventional perforating gun firing systems. For example, the system is essentially wireless, with no downhole cabling required.

The foregoing detailed description is to be clearly understood as being given by way of illustration and example only, the spirit and scope of the present invention being limited solely by the appended claims.

What is claimed is:

1. A method of operating an actuatable well tool, the method comprising the steps of:

placing the tool in a subterranean well bore;

providing a receiver operable to detect electromagnetic waves propagated through the earth and having a circuit board portion with a main CPU portion adapted to receive an electromagnetic wave detection signal and a ground signal and responsively generate an actuation request signal, and an auxiliary fail-safe CPU portion operative to receive the actuation request signal, monitor selected parameters of the tool to detect whether system errors exist, and responsively generate an actuation signal only in the absence of sensed system errors;

propagating electromagnetic waves through the earth;

detecting the electromagnetic waves; and actuating the tool in response to the detection of the electromagnetic waves and generation of the actuation signal.

2. The method of claim 1 wherein:

the placing step is performed by lowering the tool into the wellbore on a tubing structure.

3. The method of claim 1 wherein:

the placing step is performed by placing a mechanically actuatable well tool in the wellbore.

4. The method of claim 1 wherein:

the placing step is performed by placing a perforating gun in the well bore.

5. The method of claim 4 wherein:

the placing step is performed by placing a mechanically actuatable perforating gun in the wellbore.

6. The method of claim 1 wherein:

the propagating step is performed by propagating electromagnetic waves having square configurations through the earth.

7. The method of claim 6 wherein:

the propagating step is performed by propagating electromagnetic waves having modulated square configurations through the earth.

8. The method of claim 1 wherein:

the propagating step is performed by propagating electromagnetic waves having a frequency of approximately 15 Hz or less through the earth.

9. The method of claim 1 further comprising the step of:

encoding an actuation address in the electromagnetic waves.

10. A method of operating an actuatable well tool, the method comprising the steps of:

providing a sensor for sensing a predetermined downhole parameter;

providing a well tool assembly including the well tool, an electromagnetic frequency receiver, an actuation section, and a transmitter operative to transmit through the earth to a surface-disposed receiver first electromagnetic waves indicative of the value of the sensed parameter, the well tool being a mechanically actuatable well tool;

lowering the well tool assembly into a subterranean wellbore;

propagating second electromagnetic waves through a portion of the earth externally adjacent the wellbore; and utilizing the well tool assembly receiver to detect the second electromagnetic waves in the earth and responsively cause the actuation section to actuate the well tool, mechanically actuatable well tool being a perforating gun.

11. A method of operating an actuatable well tool, the method comprising the steps of:

providing a sensor for sensing a predetermined downhole parameter;

providing a well tool assembly including the well tool, an electromagnetic frequency receiver, an actuation section, and a transmitter operative to transmit through the earth to a surface-disposed receiver first electromagnetic waves indicative of the value of the sensed parameter;

lowering the well tool assembly into a subterranean wellbore;

propagating second electromagnetic waves through a portion of the earth externally adjacent the wellbore;

utilizing the well tool assembly receiver to detect the second electromagnetic waves in the earth and responsively cause the actuation section to actuate the well tool; and encoding an actuation address in the second electromagnetic waves.

12. The method of claim 11 wherein:

the well tool is a mechanically actuatable well tool.

13. The method of claim 11 wherein:

the lowering step is performed by securing the well tool assembly to a tubing structure and then lowering the tubing structure into the wellbore.

14. The method of claim 11 wherein:

the propagating step is performed by propagating electromagnetic waves having square configurations through the earth.

15. The method of claim 11 wherein:

the propagating step is performed by propagating electromagnetic waves having sine or cosine configurations through the earth.

16. The method of claim 11 wherein:

the propagating step is performed by propagating electromagnetic waves having a frequency of approximately 15 Hz or less through the earth.

17. A subterranean well comprising:

a wellbore extending through the earth; and a well tool assembly disposed in the wellbore and including:

an actuatable well tool, a receiver operable to detect electromagnetic waves propagated through the earth and responsively generate a signal, the receiver having a circuit board portion with a main CPU portion adapted to receive an electromagnetic wave detection signal and a ground signal and responsively generate an actuation request signal, and an auxiliary fail-safe CPU portion operative to receive the actuation request signal, monitor selected parameters of the well tool assembly to detect whether system errors exist, and responsively generate the first-mentioned signal only in the absence of sensed system errors, and an actuation structure operable to receive the first-mentioned signal and responsively actuate the tool.

18. The subterranean well of claim 17 wherein:

the actuatable well tool is a mechanically actuatable well tool.

19. The subterranean well of claim 18 wherein:

the mechanically actuatable well tool is a perforating gun having a mechanically actuatable firing head portion.

20. The subterranean well of claim 18 wherein:

the actuation structure includes a motor operative to mechanically actuate the well tool.

21. The subterranean well of claim 20 wherein:

the motor has an output member translatable in a selectively variable direction through a selectively adjustable stroke.

22. The subterranean well of claim 17 further comprising:

a transmitter operative to propagate electromagnetic waves through a portion of the earth externally adjacent the wellbore.

23. The subterranean well of claim 22 wherein:

the electromagnetic waves have square configurations.

24. The subterranean well of claim 23 wherein:

the electromagnetic waves are modulated square waves.

25. The subterranean well of claim 22 wherein:

the electromagnetic waves have a frequency of approximately 15 Hz or less.

26. The subterranean well of claim 22 wherein:

the electromagnetic waves have an actuation address encoded therein.

27. The subterranean well of claim 17 wherein:

the receiver is operable to generate the signal in response to detecting electromagnetic waves propagated through the earth and having both a predetermined frequency and encoded actuation address.

28. The subterranean well of claim 17 wherein:

the well tool assembly is suspended on a tubing structure extending into the wellbore.

29. A subterranean well comprising:

a wellbore extending through the earth; and a well tool assembly disposed in the wellbore and including:

an actuatable well tool, a receiver operable to detect electromagnetic waves propagated through the earth and responsively generate a signal, and an actuation structure operable to receive the signal and responsively actuate the tool, the wellbore being lined with a metal casing having a first portion, and a second portion longitudinally spaced apart from the first portion in a downhole direction, the receiver having a control circuitry portion, and the well tool assembly having first and second electrically conductive paths which are insulatively isolated from one another and are respectively operative to (1) transmit an electromagnetic wave signal from the first casing portion to the control circuitry portion, and (2) connect a ground reference from the second casing portion to the control circuitry portion.

30. The subterranean well of claim 29 wherein:

the well tool assembly has an elongated, electrically conductive tubular outer body portion and a generally coaxially extending electrically conductive tubular inner body portion, each of the outer and inner body portions having insulative gaps formed therein between adjacent longitudinal sections thereof.

31. The subterranean well of claim 30 wherein:

the adjacent longitudinal sections of the tubular outer body portion having axially spaced apart threaded end portions threadedly connected to an annular collar member at thread joints containing an electrically insulative material defining spaced apart insulation gaps between the longitudinal sections of the outer body portions and electrically isolating them from one another.

32. A well tool assembly operatively positionable in a subterranean wellbore and comprising:

an actuatable well tool;

a receiver operable to detect electromagnetic waves propagated through the earth and responsively generate a signal, the receiver having a circuit board portion with a main CPU portion adapted to receive an electromagnetic wave detection signal and a ground signal and responsively generate an actuation request signal, and an auxiliary fail-safe CPU portion operative to receive the actuation request signal, monitor selected parameters of the well tool assembly to detect whether system errors exist, and responsively generate the first-mentioned signal only in the absence of sensed system errors; and an actuation structure operative to receive the first-mentioned signal and responsively actuate the tool.

33. The well tool assembly of claim 32 wherein:

the actuable well tool is a mechanically actuatable well tool.

34. The well tool assembly of claim 33 wherein:

the mechanically actuatable well tool is a perforating gun having a mechanically actuatable firing head portion.

35. The well tool assembly of claim 33 wherein:

the actuation structure includes a motor operative to mechanically actuate the well tool.

36. The well tool assembly of claim 35 wherein:

the motor has an output member translatable in a selectively variable direction through a selectively adjustable stroke.

37. The well tool assembly of claim 32 wherein:

the receiver is operable to generate the signal in response to detecting electromagnetic waves propagated through the earth and having both a predetermined frequency and encoded actuation address.

38. A well tool assembly operatively positionable in a subterranean wellbore and comprising:

an actuatable well tool;

a receiver operable to detect electromagnetic waves propagated through the earth and responsively generate a signal; and an actuation structure operative to receive the signal and responsively actuate the tool, the receiver having a control circuitry portion, and the well tool assembly having first and second electrically conductive paths which are insulatively isolated from another and are respectively operative to (1) transmit a received electromagnetic wave signal to the control circuitry portion, and (2) transmit a received ground signal to the control circuitry portion.

39. The well tool assembly of claim 38 wherein:

the well tool assembly has an elongated, electrically conductive tubular outer body portion and a generally coaxially extending electrically conductive tubular inner body portion, each of the outer and inner body portions having insulative gaps formed therein between adjacent longitudinal sections thereof.

40. The well tool assembly of claim 39 wherein:

the adjacent longitudinal sections of the tubular outer body portion having axially spaced apart threaded end portions threadedly connected to an annular collar member at thread joints containing an electrically insulative material defining spaced apart insulation gaps between the longitudinal sections of the outer body portions and electrically isolating them from one another.

41. A perforating gun assembly operatively positionable in a subterranean wellbore and comprising:

a perforating gun having a mechanically actuatable firing head portion;

an actuating section connected to the firing head and including a motor operable to engage and mechanically actuate the firing head portion;

a receiver connected to the actuating section and being operative to detect electromagnetic waves propagated through the earth and responsively operate the motor; and a sensor operative to sense a downhole parameter; and a transmitter operative to transmit electromagnetic waves indicative of the value of the sensed downhole parameter.

42. A method of perforating a subterranean wellbore casing, the method comprising the steps of:

lowering spaced apart perforating gun assemblies through the wellbore to a portion of the casing to be perforated, each perforating gun assembly including a perforating gun having a mechanically actuatable firing head, a motor control section connected to the firing head, and an electromagnetic frequency receiver connected to the motor control section, each receiver having a circuit board portion with a main CPU portion adapted to receive an electromagnetic wave detection signal and a ground signal and responsively generate an actuation request signal, and an auxiliary fail-safe CPU portion operative to receive the actuation request signal, monitor selected parameters of the associated perforating gun assembly to detect whether system errors exist, and responsively generate a firing signal only in the absence of sensed system errors;

propagating electromagnetic waves through a portion of the earth externally adjacent the casing; and utilizing the receivers to detect the electromagnetic waves and sequentially fire the perforating guns in a preselected order.

43. For use in a subterranean wellbore, a method of operating a plurality of well tool assemblies, the method comprising the steps of:

lowering spaced apart well tool assemblies through the wellbore to a predetermined portion of the wellbore, each well tool assembly including a mechanically actuatable well tool, a motor section connected to the well tool, and an electromagnetic frequency receiver connected to the motor section;

propagating electromagnetic waves through a portion of the earth externally adjacent the casing;

utilizing the receivers to detect the electromagnetic waves and sequentially actuate the well tools in a preselected order;

providing a sensor operative to sense a predetermined downhole parameter; and providing a transmitter operative to transmit through the earth to a surface-disposed receiver electromagnetic waves indicative of the value of the sensed parameter.

44. A subterranean well comprising:

a wellbore extending through the earth; and a spaced apart plurality of well tool assemblies disposed in the wellbore and being selectively actuatable in a predetermined sequence, each well tool assembly including an actuatable well tool, a receiver operable to detect electromagnetic waves propagated through the earth and responsively generate a signal, and an actuation structure operable to receive the signal and responsively actuate the tool, the receiver having a circuit board portion with a main CPU portion adapted to receive an electromagnetic wave detection signal and a ground signal and responsively generate an actuation request signal, and an auxiliary fail-safe CPU portion operative to receive the actuation request signal, monitor selected parameters of the well tool assembly to detect whether system errors exist, and responsively generate the first-mentioned signal only in the absence of sensed system errors.

45. The subterranean well of claim 44 wherein:

the well tools are mechanically actuatable.

46. The subterranean well of claim 44 wherein:

at least one of the well tools is a perforating gun.

47. The subterranean well of claim 44 wherein at least one of the well tools is a mechanically actuatable perforating gun.

48. A subterranean well comprising:

a wellbore extending through the earth; and a well tool assembly disposed in the wellbore and including:

a mechanically actuatable well tool, a receiver operable to detect first electromagnetic waves propagated through the earth and responsively generate a signal, an actuation structure operable to receive the signal and responsively actuate the tool, a sensor for sensing a predetermined downhole parameter, and a transmitter operative to transmit directly through the earth to a surface-disposed receiver second electromagnetic waves indicative of the value of the sensed parameter, the mechanically actuatable well tool being a perforating gun have a mechanically actuatable firing head portion.

49. A subterranean well comprising:

a wellbore extending through the earth; and a well tool assembly disposed in the wellbore and including:

a mechanically actuatable well tool, a receiver operable to detect first electromagnetic waves propagated through the earth and responsively generate a signal, an actuation structure operable to receive the signal and responsively actuate the tool, a sensor for sensing a predetermined downhole parameter, and a transmitter operative to transmit directly through the earth to a surface-disposed receiver second electromagnetic waves indicative of the value of the sensed parameter, the actuation structure including a motor operative to mechanically actuate the well tool.

50. The subterranean well of claim 49 wherein:

the motor has an output member translatable in a selectively variable direction through a selectively adjustable stroke.

51. A subterranean well comprising:

a wellbore extending through the earth;

a well tool assembly disposed in the wellbore and including:

an actuatable well tool, a receiver operable to detect first electromagnetic waves propagated through the earth and responsively generate a signal, and an actuation structure operable to receive the signal and responsively actuate the tool, the subterranean well further comprising a sensor for sensing a predetermined downhole parameter, and a transmitter operative to transmit directly through the earth to a surface-disposed receiver second electromagnetic waves indicative of the value of the sensed parameter; and a transmitter operative to propagate the first electromagnetic waves, through a portion of the earth externally adjacent the wellbore, to the well tool assembly receiver, the first electromagnetic waves having an actuation addredd encoded therein.

52. The subterranean well of claim 51 wherein:

the first electromagnetic waves have square configurations.

53. The subterranean well of claim 52 wherein:

the first electromagnetic waves are modulated square waves.

54. The subterranean well of claim 51 wherein:

the first electromagnetic waves have a frequency of approximately 15 Hz or less.

55. A subterranean well comprising:

a wellbore extending through the earth; and a well tool assembly disposed in the wellbore and including:

an actuatable well tool, a receiver operable to detect first electromagnetic waves propagated through the earth and responsively generate a signal, an actuation structure operable to receive the signal and responsively actuate the tool, a sensor for sensing a predetermined downhole parameter, and a transmitter operative to transmit directly through the earth to a surface-disposed receiver second electromagnetic waves indicative of the value of the sensed parameter, the well tool assembly receiver being operable to generate the signal in response to detecting electromagnetic waves propagated through the earth and having both a predetermined frequency and encoded actuation address.

56. A well tool assembly operatively positionable in a subterranean wellbore and comprising:

an mechanically actuatable well tool;

a receiver operable to detect first electromagnetic waves propagated through the earth and responsively generate a signal;

an actuation structure operative to receive the signal and responsively actuate the tool;

a sensor for sensing a predetermined downhole parameter; and a transmitter operative to transmit directly through the earth to a surface-disposed receiver second electromagnetic waves indicative of the value of the sensed parameter, the mechanically actuatable well tool being a perforating gun having a mechanically actuatable firing head portion.

57. A well tool assembly operatively positionable in a subterranean wellbore and comprising:

an mechanically actuatable well tool;

a receiver operable to detect first electromagnetic waves propagated through the earth and responsively generate a signal;

an actuation structure operative to receive the signal and responsively actuate the tool;

a sensor for sensing a predetermined downhole parameter; and a transmitter operative to transmit directly through the earth to a surface-disposed receiver second electromagnetic waves indicative of the value of the sensed parameter, the actuation structure including a motor operative to mechanically actuate the well tool.

58. The well tool assembly of claim 57 wherein:

the motor has an output member translatable in a selectively variable direction through a selectively adjustable stroke.

59. A well tool assembly operatively positionable in a subterranean wellbore and comprising:

an actuatable well tool;

a receiver operable to detect first electromagnetic waves propagated through the earth and responsively generate a signal;

an actuation structure operative to receive the signal and responsively actuate the tool;

a sensor for sensing a predetermined downhole parameter; and a transmitter operative to transmit directly through the earth to a surface-disposed receiver second electromagnetic waves indicative of the value of the sensed parameter;

the well tool assembly receiver being operable to generate the signal in response to detecting electromagnetic waves propagated through the earth and having both a predetermined frequency and encoded actuation address.

* * * * *